United States Patent [19]

Hossfield et al.

[11] Patent Number: 5,033,278

[45] Date of Patent: Jul. 23, 1991

[54] WASHING MACHINE BRAKE AND RELEASE MECHANISM

[75] Inventors: Robin C. Hossfield, Medway; Ronald A. Goyette, Ashby, both of Mass.; Patrick J. Radle, Ripon, Wis.

[73] Assignee: Raytheon Company, Lexington, Mass.

[21] Appl. No.: 508,679

[22] Filed: Apr. 12, 1990

[51] Int. Cl.[5] ..... D06F 37/40

[52] U.S. Cl. ..... 68/23.7; 188/72.7; 188/166; 192/7

[58] Field of Search ..... 68/23.7; 192/7; 188/72.3, 72.7, 166

[56] References Cited

U.S. PATENT DOCUMENTS

| | | | |
|---|---|---|---|
| 2,826,056 | 3/1958 | Bruckman | 68/23.7 |
| 3,576,117 | 4/1971 | Cowan et al. | 68/23.7 |
| 4,165,624 | 8/1979 | Ruble | 68/23.7 |
| 4,291,556 | 9/1981 | Mason | 68/23.7 |
| 4,890,465 | 1/1990 | Burk et al. | 68/23.7 |

*Primary Examiner*—Philip R. Coe

*Attorney, Agent, or Firm*—William R. Clark; Richard M. Sharkansky

[57] ABSTRACT

A washing machine brake and release mechanism adapted for use with a motor that is alternately reversed in direction to provide drive during an agitator cycle, and is driven unidirectionally to provide drive for a spin cycle. The motor is linked through a speed reducer that has an output disc connected to the shaft of the agitator. A collar discriminator releases the washer brake when the disc is driven unidirectionally; however, the collar discriminator leaves the brake engaged when the disc is rotated through a stroke arc less than 360°. The collar discriminator has a pair of downwardly extending pins that ride up on ramps positioned on the top surface of the disc when driven unidirectionally thereby causing the discriminator to push up against and release the brake. When the disc is alternately reversed through some arc less than 360° such as during an agitate cycle, the ramps are arranged so as to avoid engaging the pins of the collar discriminator thereby leaving the brake engaged.

13 Claims, 4 Drawing Sheets

WASHING MACHINE BRAKE AND RELEASE MECHANISM

BACKGROUND OF THE INVENTION

The field of the invention generally relates to automatic washing machines, and more particularly relates to a brake and release mechanism for a washing machine having an alternately reversing drive motor.

In the most common arrangement of prior art automatic washing machines, a reversible drive motor is connected to a reciprocating transmission with a drive belt. When the motor drives the input shaft of the transmission in one direction, here designated clockwise for convenience of discussion, the transmission provides reciprocating motion to its output shaft which is connected to the washer agitator located within the spin tub or clothes basket. That is, in response to a uni-directional clockwise drive, the output shaft of the transmission oscillates back and forth through a predetermined arc thus providing an agitator stroke. When the drive motor is driven in the opposite or counterclockwise direction, the spin tub is rapidly rotated to centrifugally extract washing fluid from the clothes during a spin cycle. Typically, a brake is engaged so that the spin tub will not rotate during an agitate cycle, and the brake is released when the motor is reversed (i.e. driven in the counterclockwise direction) to provide the rapid spinning of the spin tub. The brake is also used at the end of the spin cycle to stop the spin tub from spinning.

One prior art brake mechanism is described in U.S. Pat. No. 3,838,755. The brake mechanism includes a pair of generally flat circular plates adapted to be moved axially relative to one another to frictionally compress one or more stationary brake pads wherein one of the plates is fixed to a shaft connected to the spin tub. A conical spring is positioned adjacent the moveable plate and urges that plate towards the other plate so as to clamp the brake pads. Deflection of the inner periphery of the conical spring causes its outer periphery to move away from the axial moveable plate, thereby releasing the braking force applied to the brake pads positioned between the two plates. The brake mechanism is then free to rotate with the spin tub shaft. By permitting the inner periphery of the conical spring to return to its undeflected positioned, the braking force is reapplied to prevent rotation of the spin tub shaft.

In order to release the brake of the above described mechanism, the driven pulley has an underside hub that has helical surfaces that are supported on a conforming helical washer. When the driven pulley rotates in the clockwise direction, the pulley remains in a down position and drives the helical washer which has an internal surface coupled to the input shaft to the transmission. However, when the driven pulley rotates in the counterclockwise direction, it rides up on the inclined surfaces of the helical washer and pushes up against the conical spring thereby deflecting it and releasing the brake. In other words, when the motor drives in one direction, the brake is engaged; and when the motor drives in the opposite direction, the brake is mechanically released.

The above described brake release mechanism has a drawback, however, in that it is not applicable to a relatively new washer design that uses a permanent split capacitor motor. More specifically, permanent split capacitor motors have recently been used to drive commercially available washers. Such motors have a significant advantage in that their rotational direction can be reversed quickly enough so that expensive reciprocating transmissions are no longer required. In other words, the direction reversal for the agitate mode comes directly from the motor rather than driving a reciprocating transmission unidirectionally. The above described brake release mechanism is not applicable to such permanent split capacitor motor arrangements because such release mechanism depends on a shaft being driven in one direction for agitate and in the opposite for spin. As a result, prior art washers with permanent split capacitor motors have used expensive solenoids to release the brake so as to initiate a spin cycle.

SUMMARY OF THE INVENTION

It is an object of the invention to provide an improved brake and release mechanism for use with a washing machine having an alternately reversing motor for driving an agitator during an agitate cycle.

It is also an object to provide a brake release discriminator that is responsive to the motion characteristic of a speed reducer output disc connected to the shaft of the agitator. Another object is to provide a mechanical discriminator that releases the brake when the disc is driven unidirectionally. However, it is a further object that the discriminator generally leave the brake engaged when the output disc is driven back and forth through some arc such as 240° during an agitate cycle.

In accordance with the invention, there is provided a washing machine comprising a clothes basket having an agitator, a first shaft connected to the agitator, a disc coupled to the first shaft, a second shaft connected to the clothes basket, a brake coupled to the second shaft, first means for rotating the disc and the first shaft in alternate directions through a predetermined arc to drive the agitator reciprocally during an agitation cycle of the washing machine and for rotating the disc and the first shaft unidirectionally to drive the agitator during a spin cycle of the washing machine, and second means responsive to the disc being driven unidirectionally for releasing the brake and for rotating the second shaft and the clothes basket during the spin cycle of the washing machine. It may be preferable that the first means comprise an alternately reciprocating motor coupled to a speed reducer such as a planetary transmission. Also, it may be preferable that the disc comprises a planet carrier of the planetary transmission.

In a preferred embodiment, the disc may have an upper surface and the second means may comprise an upperly directed ramp on the surface and a collar around the first and second shafts wherein the collar has a downwardly extending pin that is driven upwardly by the pin riding up on the ramp as the disc is rotated so as to release the brake. Preferably, the disc may have first and second ramps on opposing sides at different radii from the center of the disc, and the collar may have first and second downwardly extending pins each aligned to engage a respective one of the first and second ramps as the disc is rotated so as to drive the collar upwardly against the brake.

With such arrangement, an inexpensive mechanical discriminator responds to the output disc of the planetary transmission being driven unidirectionally for releasing the brake and for driving the spin tub. However, the pins of the discriminator collar are arranged with respect to the ramps on the planetary carrier disc such that the brake is not released when the planet carrier disc is driven through a typical arc of an agitator stroke.

BRIEF DESCRIPTION OF THE DRAWINGS

The foregoing objects and advantages will be more fully understood by reading the description and preferred embodiments with reference to the drawings wherein.

DESCRIPTION OF THE PREFERRED EMBODIMENTS

Figure 1:
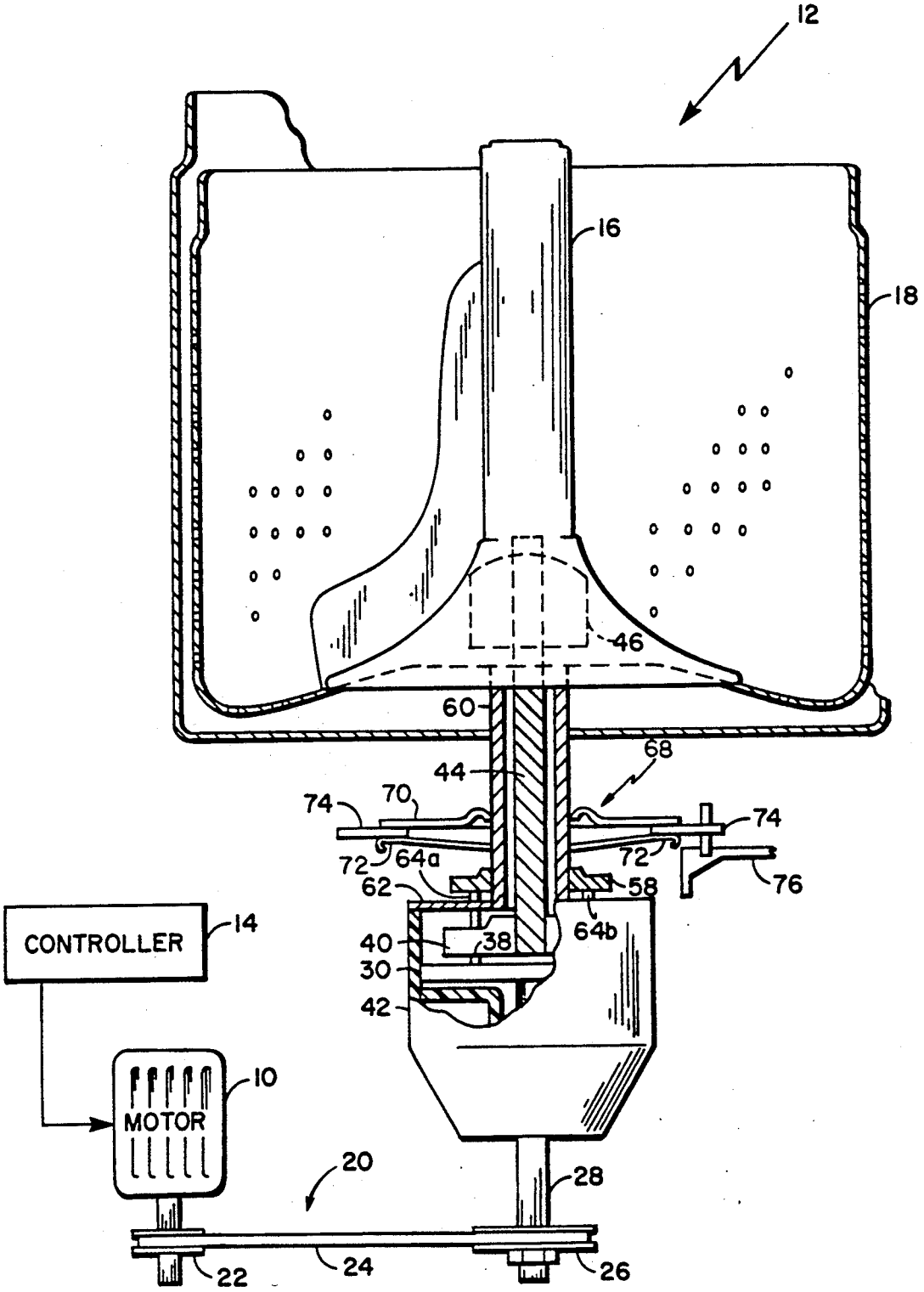
FIG. 1 is a side sectioned view of a washing machine including an alternately reversing motor.

Referring to FIG. 1, a rapidly reversing motor 10 provides the drive for automatic washing machine 12. Although other types of rapidly reversing motors 10 could be used, here motor 10 is a permanent split capacitor (PSC) motor that is energized by controller 14. In the agitate mode of operation wherein agitator 16 is to be oscillated back and forth, controller 14 alternately switches line voltage to the respective stator windings (not shown) of PSC motor 10 so as to cause motor 10 to alternately reverse directions at a relatively fast stroke rate such as, for example, 60 strokes per minute. In the spin mode of operation wherein perforated spin tub 18 or clothes basket is to be rapidly rotated in one direction to extract washing fluid from the clothes by centrifugal force, controller 14 applies line voltage to cause PSC motor 10 to drive unidirectionally for the duration of the spin cycle.

Figure 2:
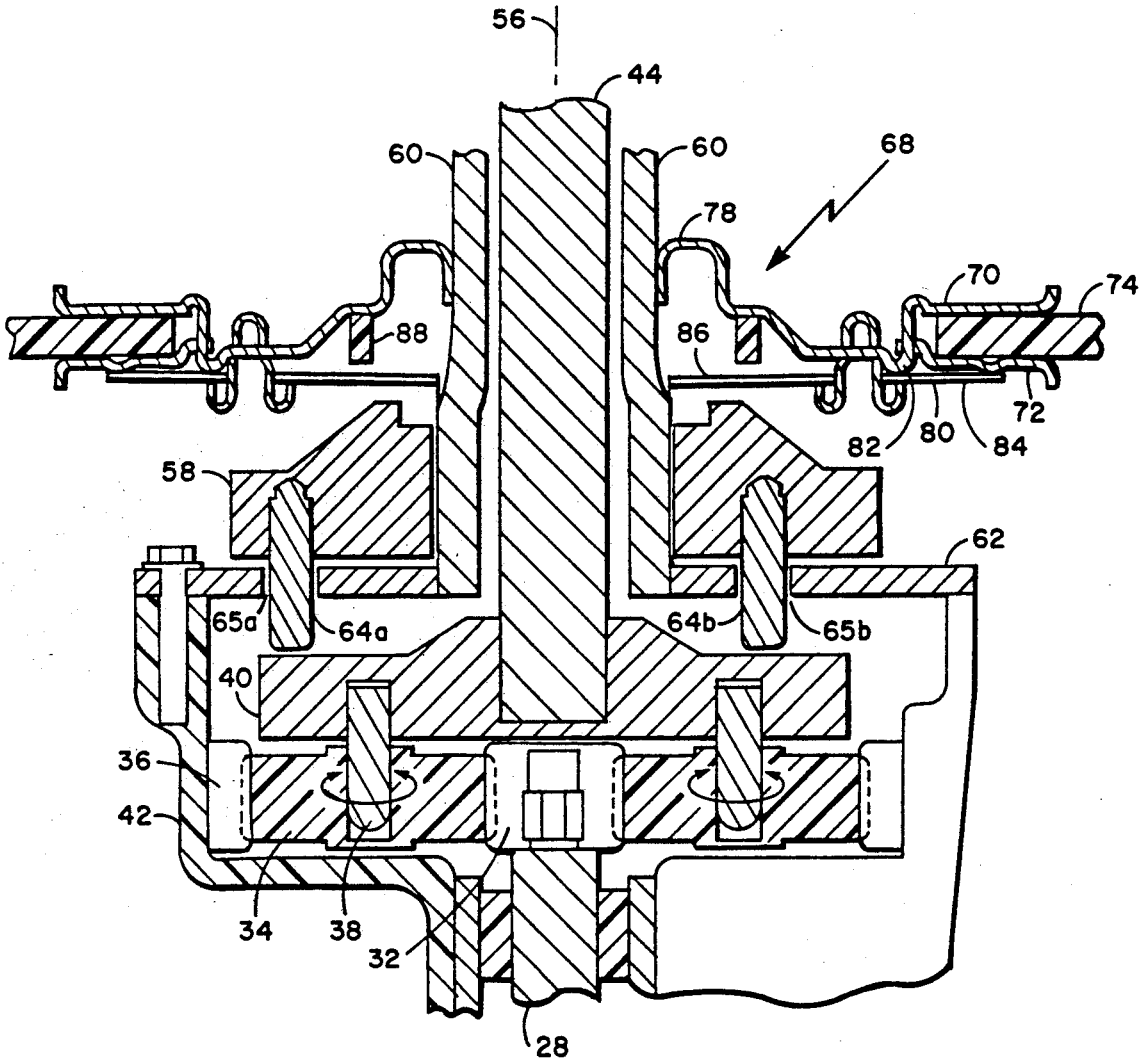
FIG. 2 is a side sectioned view of the planetary transmission and collar discriminator with the brake in the engaged position.

PSC motor 10 is suitably mounted and connected by a pulley arrangement 20 including drive pulley 22, belt 24, and driven pulley 26 to the input shaft 28 of a speed reducer, here planetary transmission 30. More specifically, conventional planetary transmission 30, as shown in FIG. 2, includes a sun gear 32 surrounded and engaged by a plurality of planet gears 34, and an inner-toothed ring gear 36. Each of the planet gears 34 has a planetary shaft 38 that is rotatably coupled to a planet carrier 40 that rotates at the rate that the planet gears 34 propagate or travel around sun gear 32. The outer inner-toothed ring gear 36 is engaged to transmission housing 42. Thus, in the agitate mode of operation, planet carrier 40 is oscillated back and forth through a predetermined stroke arc such as, for example, 240°, in response to input shaft 28 driving sun gear 32 in alternately reversing directions. As is well known, the speed reduction ratio is determined by the relationship between sun gear 32 and the planet gears 34. A typical speed reduction ratio is 6.5:1 wherein the input shaft 28 would be driven in a reciprocating arc of 1560° to provide a 240° stroke arc for planet carrier 40. Planet carrier 40 is a disc rotatably fixed to output shaft 44 by teeth 45 (FIG. 3), and output shaft 44 is connected by hub 46 to agitator 16. Thus, in the agitate mode of operation, PSC motor 10 may typically drive agitator 16 at a stroke rate of 60 strokes per minute through a stroke arc of 240° by alternately reversing input shaft 28 through an arc of 1560°.

Figure 3:
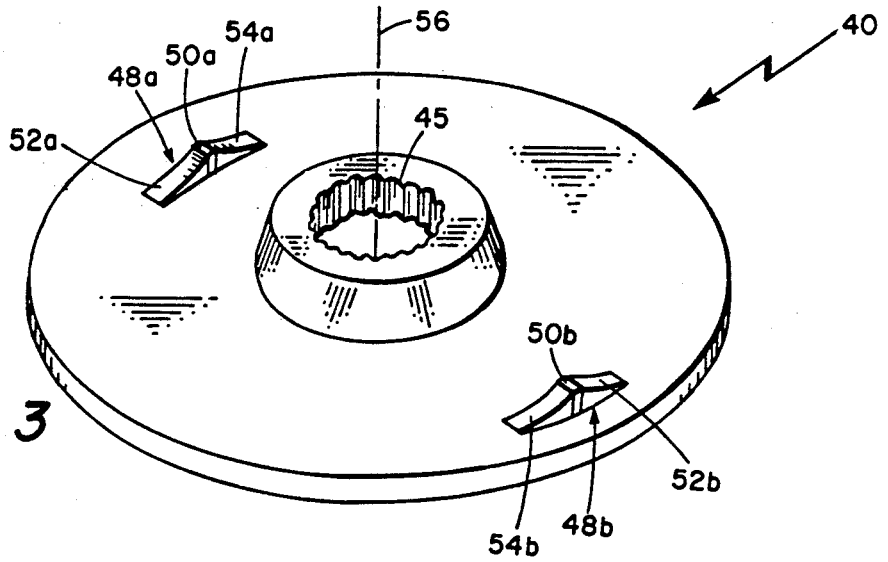
FIG. 3 is a perspective view of the planet carrier disc.
Figure 4:
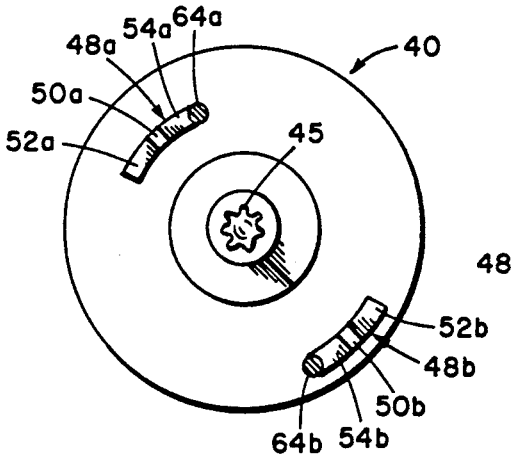
FIG. 4 shows the orientation of the ramps of the planet carrier disc with respect to the brake releasing pins at the beginning of a typical agitate cycle.
Figure 5:
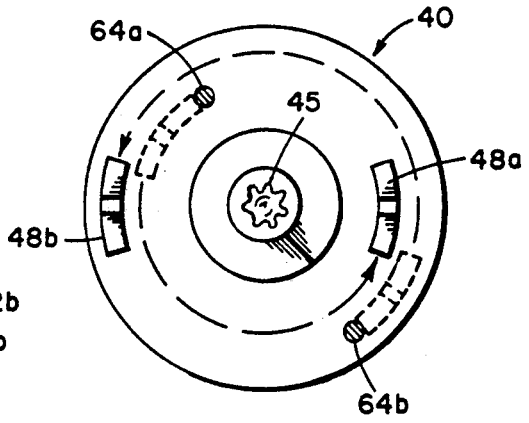
FIG. 5 shows the orientation of the ramps and the pins after a typical 240° rotation of the planet carrier.

Referring also to FIG. 3, planet carrier 40 has a pair of arcuate ramps 48*a* and 48*b*, each having a central plateau region 50*a* and 50*b* and inclined surfaces 52*a* and 52*b*, and 54*a* and 54*b*, in both arcuate directions. Ramps 48*a* and 48*b* are located at different radial distances from the center axis 56 of planet carrier 40. As shown in FIGS. 1 and 2, a collar discriminator 58 is positioned around spin tub shaft 60 that concentrically encases output shaft 44, and collar discriminator 58 is positioned above the top 62 of housing 42. A pair of brake release pins 64*a* and 64*b* are engaged to and extend downwardly from collar discriminator 58 and protrude through corresponding apertures 65*a* and 65*b* in top 62. As shown best in FIG. 4, pin 64*a* is at the same radial distance as ramp 48*a*, and pin 64*b* is at the same radial distance as ramp 48*b*. FIG. 4 shows the approximate orientation of pins 64*a* and 64*b* to respective ramps 48*a* and 48*b* at the beginning of a typical agitate cycle. In response to input shaft 28 driving sun gear 32 through a predetermined arc, planet carrier 40 is driven in conventional manner through a reduced arc such as, for example, 240°. An agitate cycle is always initiated by driving planet carrier 40 in the same direction, here designated counterclockwise. Accordingly, FIG. 4 shows the orientation of pins 64*a* and 64*b* to respective ramps 48*a* and 48*b* after such 240° rotation. It is noted that even though pins 64*a* and 64*b* are spaced oppositely with respect to each other and ramps 48*a* and 48*b* are spaced oppositely with respect to each other, ramps 48*a* and 48*b* do not engage respective pins 64*b* and 64*a* because they are at different radial distances. In other words, given the initial orientation as shown in FIG. 4, planet carrier 40 can rotate almost the whole way around before either ramp 48*a* or 48*b* engages either pin 64*a* or 64*b*, and that would occur when ramp 48*a* engages pin 64*a* from the counterclockwise direction simultaneous to ramp 48*b* engaging pin 64*b* from the counterclockwise direction. An agitate stroke is completed by planet carrier 40 being driven approximately 240° clockwise from the orientation shown in FIG. 5 back to the initial orientation shown in FIG. 4, and it is noted that pins 64*a* and 64*b* are not contacted. In summary, during the typical agitate mode of operation, planet carrier 40 drives agitator 16 back and forth through some predetermined stroke arc, and ramps 48*a* and 48*b* do not engage pins 64*a* and 64*b*.

Still referring to FIG. 1, the spin tub 18 is connected to the spin tub shaft 60 which is splined to brake assembly 68. Although many other types of brakes could be used, here brake assembly 68 includes a pair of generally flat circular plates 70 and 72 adapted to be moved axially relative to one another to frictionally compress one or more brake pads 74 that are affixed to the frame 76 of the washing machine. Also referring to FIG. 2, one of the plates 70 has an inner portion 78 splined to the rotatable spin tub shaft 60. A conical spring 80 is positioned adjacent the moveable plate 72 and is pivotable about an annular fulcrum defined by a downward bent flange 82 of plate 70. In the operational state as shown in FIG. 2, the outer periphery 84 of conical spring 80 engages axially moveable plate 72 forcing it upwardly so as to clamp brake pad 74 and prevent brake assembly 68 from rotating with respect to brake pads 74. Thus, in the agitate mode, the brake assembly 68 is typically configured as shown in FIG. 2 such that the spin tub shaft 60 is anchored to the frame 76 by the respective plates 70 and 72 of the brake assembly 68 compressing on brake pad 74. Accordingly, brake assembly 68 typically locks spin tub 18 so that it does not rotate during the agitate mode of operation.

Figure 6:
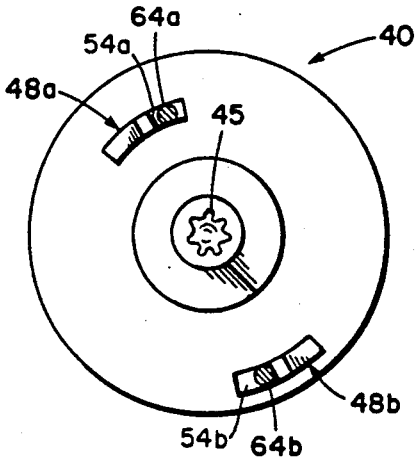
FIG. 6 shows the orientation of the ramps and the pins during a typical spin cycle.

In the spin mode of operation, controller 14 causes motor 10 to drive unidirectionally, which drives belt 24, input shaft 28, sun gear 32, and planet carrier 40 in the same direction, here designated clockwise for convenience of discussion. As is shown in FIG. 6, ramp 48*a* engages pin 64*a* and ramp 48*b* engages pin 64*b*, and pins 64*a* and 64*b* ride up on respective inclined surfaces 54*a* and 54*b* causing collar discriminator 58 to elevate. It is desirable that pin 64*a* and 64*b* rise the same distance for a given arcuate rotation of planet carrier 40 so that collar discriminator 58 remains level as it is elevated. Accordingly, the respective inclined surfaces 54*a* and 54*b* (and also 52*a* and 52*b*) are selected to compensate for the different arcuate travel distances of respective ramps 48*a* and 48*b* caused by their being at different radial distances from axis 56. For example, if ramps 48*b* and 48*a* are approximately 1.50" and 1.323" respectively from axis 56, the inclined surfaces 54*b* and 54*a* could have slopes of 35° and 29.2° respectively.

Figure 8:
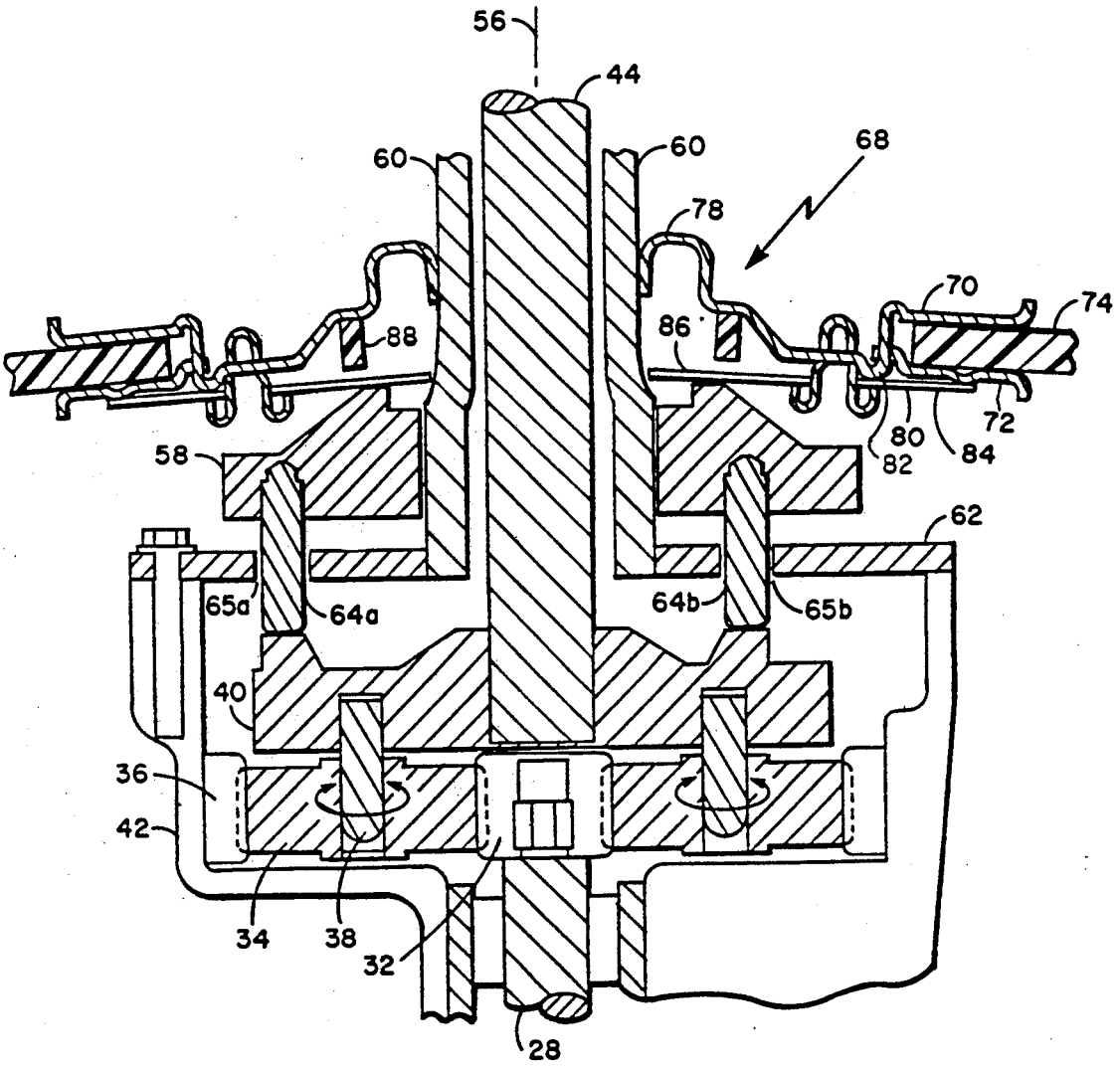
FIG. 8 is a side sectioned view similar to FIG. 2 with the brake released.

As pins 64*a* and 64*b* ride up on respective ramps 48*a* and 48*b*, collar discriminator 58 elevates as shown in FIG. 8. As collar discriminator 58 travels upwardly, it pushes on the inner peripheral region 86 of conical spring 80 thereby deflecting it on an annular fulcrum defined by flange 82. Such deflection causes the outer periphery 84 of conical spring 80 to move downwardly away from axially moveable plate 72 thereby releasing the braking force supplied to the brake pads 74 positioned between the two plates 70 and 72. This action releases brake assembly 68 thereby freeing brake assembly 68 to rotate along with spin tub shaft 60 and spin tub 18. Snubber ring 88 is positioned between plates 70 and 72 and is made of a resilient material that resists deflection of conical spring 80 past a predetermined point. Accordingly, in the normal spin mode operation, pins 64*a* and 64*b* are inhibited from climbing up and over plateau regions 50*a* and 50*b* and down the opposite inclined surfaces 52*a* and 52*b*. Rather, in the normal spin mode of operation, pins 64*a* and 64*b* stay engaged to respective inclined surfaces 54*a* and 54*b* and are rotatably driven by planet carrier 40. Top 62 of housing 42 is connected to spin tub shaft 60 and therefore is prevented from rotating when brake assembly 68 is engaged. However, when brake assembly 68 is released by collar discriminator 58 rising upwardly, top 62 and the entire transmission housing 42 are free to rotate in response to the drive torque exerted on pins 64*a* and 64*b* by ramps 48*a* and 48*b*, respectively. Top 62 is connected to spin tub shaft 60 and thus, drive is also provided to rotate spin tub 18. Because ring gear 36 is engaged to the transmission housing 42 and driven at the same speed as planet carrier 40, planetary transmission 30 locks up resulting in a direct drive between input shaft 28 and the output shaft 44 and spin tub shaft 60. Because the spin tub 18 and the agitator 16 are connected to the spin tub shaft 60 and output shaft 44, respectively, the spin tub 18 and agitator 16 are rotated at the drive speed of input shaft 28. At the completion of the spin cycle, motor 10 is deenergized, drive to planet carrier 40 is removed, and the downward deflecting force of conical spring 80 causes collar discriminator 58 and pins 64*a* and 64*b* to be urged downwardly. Accordingly, conical spring 80 once again applies a braking force against plate 72 urging it upwardly to compress stationary pads 74 between respective plates 70 and 72. Such braking causes drag on brake assembly 68 which is connected to spin tub shaft 60 thereby slowing and finally stopping the rotation of spin tub 18.

Figure 7:
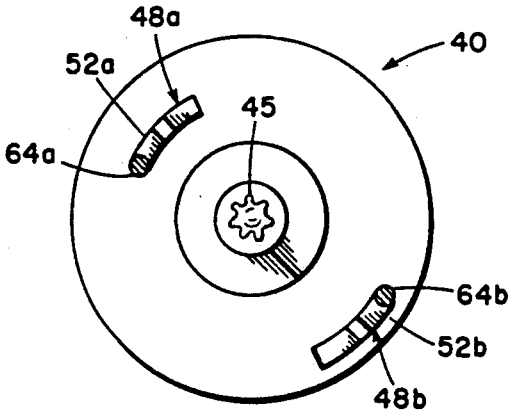
FIG. 7 shows the orientation of the ramps and the pins after the brake has been briefly released and re-engaged during an agitate cycle.

It is noted that at the end of a spin cycle, ramps 48*a* and 48*b* would normally be proximate or engaging respective pins 64*a* and 64*b* as shown in FIG. 4. Accordingly, the orientation of the respective ramps 48*a* and 48*b* to respective pins 64*a* and 64*b* is set for the initiation of an agitate cycle in the counterclockwise direction as described heretofore. That is, the ramps 48*a* and 48*b* are free to rotate through a stroke having an arc less than approximately 330° initiated in the counterclockwise direction without engaging respective pins 64*a* and 64*b*. However, it is noted that for a number of reasons such as the agitator 16 being moved between the completion of a spin cycle and the initiation of an agitate cycle, the orientation of ramps 48*a* and 48*b* with respect to pins 64*a* and 64*b* may be different than shown in FIG. 4. In such event, the ramps 48*a* and 48*b* may contact respective pins 64*a* and 64*b* within the first 240° counterclockwise rotation of an initiated agitate cycle. For this reason, surfaces 52*a* and 52*b* are inclined so that pins 64*a* and 64*b* will ride up on them thereby releasing brake assembly 68 in a manner similar to that described with reference to the spin cycle. It is noted that if ramps 48*a* and 48*b* contacted respective pins 64*a* and 64*b* and such action did not operate to elevate collar discriminator 58 to release brake assembly 68 and free top 62 for rotation, pins 64*a* and 64*b* could break off or otherwise be damaged. The action of briefly releasing brake assembly 68 during an agitate cycle is not detrimental to the workings of the machine or the agitate cycle. Specifically, it has been found that the brake assembly 68 may be released during an agitate stroke thereby enabling the spin tub shaft 60 and spin tub 18 to rotate for the remainder of the agitate stroke arc. Because the first half-stroke of an agitate cycle is always in the same direction, here designated counterclockwise, the ramps 48*a* and 48*b* would be aligned with respect to pins 64*a* and 64*b* as shown in FIG. 7. As a result, ramps 48*a* and 48*b* would now be self-aligned to pins 64*a* and 64*b* such that ramps 48*a* and 48*b* would rotate back and forth for the remainder of the strokes in the agitate cycle without ever engaging pins 64*a* and 64*b* to release brake assembly 68. Then, after the next spin cycle, the orientation of ramps 48*a* and 48*b* with respect to pins 64*a* and 64*b* would typically be that as shown in FIG. 4.

In a preferred embodiment, the slope of inclined surfaces 52*a* and 52*b* and 54*a* and 54*b* may be nonlinear such as having a steeper slope at the beginning. For example, the initial slope may be 45° and the inner slope may be 30°. With such arrangement, the brake is less likely to be released and reengaged during braking at the completion of a spin cycle caused by the collar discriminator 58 being slowed by the brake while the inertia of the motor 10 and pulley arrangement 20 continues to drive planetary transmission 30 and planet carrier 40.

In an alternate embodiment, ramps 48*a* and 48*b* could be positioned in arcuate channels in the top surface of planet carrier 40 such that pins 64*a* and 64*b* would travel within the channels and would be guided up onto ramps 48*a* and 48*b* as described heretofore. In another alternate embodiment, pins 64*a* and 64*b* could be aligned horizontally for riding up on ramps 48*a* and 48*b*. In still another embodiment, ramps 48*a* and 48*b* could be reversed with pins 64*a* and 64*b* such that the inclined surfaces 52*a* and 52*b* and 54*a* and 54*b* would be formed as part of collar discriminator 58. Also, a motor 10 could be used such that planetary transmission 30 or any other speed reducers would not be required; in such case, collar discriminator 58 could be made responsive to an annular protruding portion of shaft 44 or a coupling connected thereto rather than the disc surface defined by the planet carrier 40.

This concludes the description of the preferred embodiments. A reading of it by one skilled in the art will bring to mind many alterations and modifications without departing from the spirit and scope of the invention. Accordingly, it is intended that the scope of the invention be limited only by the appended claims

What is claimed is:

1. A washing machine comprising:

a clothes basket having an agitator therein;

a first shaft connected to said agitator;

a disc coupled to said first shaft;

a second shaft connected to said clothes basket;

means for braking said second shaft;

first means for rotating said disc and said first shaft in alternate directions through a predetermined arc to drive said agitator reciprocally during an agitation cycle of said washing machine and for rotating said disc and said first shaft unidirectionally to drive said agitator during a spin cycle of said washing machine; and second means mechanically responsive to motion of said disc for leaving said brake engaged when said disc is rotated in alternate directions during one of said agitation cycles and for releasing said brake when said disc is rotated unidirectionally to enable rotation of said second shaft and said clothes basket during one of said spin cycles of said washing machine.

2. The washing machine recited in claim 1 wherein said first means comprises a motor and means for alternately reversing the drive direction of said motor to drive said agitator reciprocally during said agitation cycle, said first means further comprising a speed reducer coupled between said motor and said disc.

3. The washing machine recited in claim 2 wherein said speed reducer comprises a planetary transmission.

4. The washing machine recited in claim 3 wherein said disc comprises a planet carrier of said planetary transmission.

5. A washing machine comprising:

a clothes basket having an agitator therein;

a first shaft connected to said agitator;

a disc coupled to said first shaft;

a second shaft connected to said clothes basket;

a brake coupled to said second shaft;

first means for rotating said disc and said first shaft in alternate directions through a predetermined arc to drive said agitator reciprocally during an agitation cycle of said washing machine and for rotating said disc and said first shaft unidirectionally to drive said agitator during a spin cycle of said washing machine;

second means responsive to said disc being driven unidirectionally for releasing said brake and for rotating said second shaft and said clothes basket during said spin cycle of said washing machine; and wherein said disc has an upper surface and said second means comprises an upwardly directed ramp on said disc surface and a collar around said first and second shafts, said collar having a downwardly extending pin wherein said collar is driven upwardly by said pin riding up on said ramp as said disc is rotated to release said brake.

6. The washing machine recited in claim 5 wherein said disc has first and second ramps on opposing sides of said surface at different radii from the center of said disc, said collar having first and second downwardly extending pins each aligned to engage one of said first and second ramps as said disc is rotated to drive said collar upwardly against said brake.

7. The washing machine recited in claim 6 wherein said first and second ramps each has a pair of inclined surfaces.

8. The washing machine recited in claim 7 wherein said first and second pins extend through respective apertures in a plate coupled to rotationally drive said second shaft.

9. The washing machine recited in claim 8 wherein said brake comprises first and second generally circular plates adapted to be axially moveable relative to one another to engage at least one stationary brake pad positioned therebetween, said brake further comprising a conical spring positioned below said first and second plates and being adapted for being deflected upwardly by an upward force exerted by said collar to release said brake.

10. The washing machine recited in claim 9 wherein said brake further comprises means for snubbing deflection motion of said conical spring.

11. The washing machine recited in claim 10 wherein said snubbing means comprises a resilient ring position between said first and second plates.

12. A washing machine, comprising:

an agitator positioned in a spin tube;

a first shaft connected to said spin tube;

a second shaft connected to said spin tube;

a brake connected to said second shaft;

means comprising a coupling for driving said first shaft and said agitator back and forth through an arc less than 360 degrees during an agitate cycle and for driving said first shaft unidirectionally during a spin cycle;

said driving means further comprising a motor and means for alternating the direction of drive for said motor to provide said back and forth drive for said shaft and said agitator during said agitation cycle; and means responsive to motion of said coupling for discriminating whether said first shaft is being driven back and forth or unidirectionally, and for releasing said brake and for driving said second shaft and said spin tube when said first shaft is driven unidirectionally, said releasing and driving means being unresponsive to back and forth motion of said coupling wherein said brake remains substantially engaged during said agitate cycle.

13. The washing machine recited in claim 12 wherein said coupling comprises a disc coupled to said first shaft.

* * * * *